US005806740A

United States Patent [19]

Carlson

[11] Patent Number: 5,806,740

[45] Date of Patent: Sep. 15, 1998

[54] MODULAR LOAD CARRYING EQUIPMENT

[75] Inventor: Dennis Carlson, Bloomfield Hills, Mich.

[73] Assignee: Raytheon Company, Lexington, Mass.

[21] Appl. No.: 589,809

[22] Filed: Jan. 22, 1996

[51] Int. Cl.[6] ..... A45F 3/04

[52] U.S. Cl. ..... 224/628; 224/259; 224/262; 224/627; 224/631; 224/632; 224/633; 224/634; 224/635; 224/637

[58] Field of Search ..... 224/210, 211, 224/259, 260–263, 627–637, 903

[56] References Cited

U.S. PATENT DOCUMENTS

| | | | |
|---|---|---|---|
| 2,428,906 | 10/1947 | Cannella . | |
| 3,563,431 | 2/1971 | Pletz . | |
| 4,013,201 | 3/1977 | Potter . | |
| 4,361,259 | 11/1982 | Chanter | 224/635 |
| 4,676,418 | 6/1987 | Lowe . | |
| 4,911,346 | 3/1990 | Shallman | 224/221 |
| 5,004,135 | 4/1991 | Dufournet et al. | 224/262 |
| 5,449,102 | 9/1995 | Sason | 224/632 |
| 5,503,314 | 4/1996 | Fiscus | 224/634 |
| 5,564,612 | 10/1996 | Gregory . | |

FOREIGN PATENT DOCUMENTS

| | | |
|---|---|---|
| 0 350 841 A | 1/1990 | European Pat. Off. . |
| 0 628 265 A | 12/1994 | European Pat. Off. . |
| 2 677 235 A | 12/1992 | France . |
| 764 880 | 1/1957 | United Kingdom . |
| 870 215 | 6/1961 | United Kingdom . |
| WO 87 01017 A | 1/1996 | WIPO . |

*Primary Examiner*—David J. Walczak
*Assistant Examiner*—Timothy L. Maust
*Attorney, Agent, or Firm*—Leonard A. Alkov; Glenn H. Lenzen, Jr.

[57] ABSTRACT

An improved universal adjustable modular load backpack for carrying heavy loads to be used in conjunction with a multi-functional, soldier-centered, computer enhanced warfare system includes storage modules releasably mounted on a flexible pack frame extending the wearer's level of comfort and range of motion. The storage modules provide for a versatile pack load configuration and may be quickly withdrawn from the pack frame by the wearer without removing the pack frame. The pack frame is also provided with an integrated adjustment mechanism for selectively increasing or decreasing the length of the shoulder support straps and rib-cage straps of the backpack, and the distance between the waist belt and the pack frame so as to adapt to the wearer's torso and waist without having to remove the backpack from the wearer's back.

26 Claims, 9 Drawing Sheets

MODULAR LOAD CARRYING EQUIPMENT

BACKGROUND OF THE INVENTION

This invention relates generally to a modular load carrying equipment.

Modern technology, especially computers and electronics, have advanced rapidly in the recent past. It is desirable that these technological advances be applied to the art of war, specifically to weapons and other equipment designed to make the modern soldier a more efficient "fighting machine." An important component in the complete arsenal of the modern soldier includes a backpack often referred to as Load Carrying Equipment (LCE). The LCE is required to transport often heavy weapon and technological equipment over rough terrain for an extended period of time.

The Load Carrying Equipment should provide freedom of movement and immediate accessibility to vital equipment carried by the wearer without missing a step. Commercially available backpacks that are designed to carry heavy loads over extended periods of time are typically based on rigid or semi-rigid frames. These frames are typically internal or external to the main backpack and provide structure to the backpack for load distribution. Such backpack frames are also generally equipped with adjustable shoulder supports and a waist belt so as to most effectively and comfortably locate the backpack load on the back of the wearer.

However, some of the disadvantages of the systems employed by these backpack frames is that the frame assembly is heavy, and does not flex in order to provide maximum mobility and provides no protection to electronic components and wiring harness that may be stowed onto the backpack frame.

In addition to the foregoing, other types of frame backpacks push the load carried by the frame away from the back of the wearer moving the center of gravity away from the body of the wearer. Another disadvantage of heretofore known backpacks is that although they typically employ adjustable shoulder straps and an adjustable waist belt, the backpacks must be removed from the back of the wearer to make gross adjustments between the shoulder straps and waist belt to accommodate different wearer sizes and shapes.

SUMMARY OF THE INVENTION

The present invention provides an improved portable backpack which incorporates a flexible frame having a device affixed to the frame for quickly removing the load being carried.

An object of the present invention is to provide an improved Load Carrying Equipment (LCE) that is designed to increase soldier agility and reduce physical fatigue of the soldier from the weight of the load being carried, and to enhance the effectiveness of the soldier's performance in the battlefield.

The LCE frame is typically constructed of a thin reinforced split thermoplastic material such as high density polyethylene to which is attached a plurality of modular load packs onto multiple attachment points on the frame for retaining and/or transporting various equipment. The LCE may include integral electrical wires and components within the frame and rib-cage straps to allow communication between the various pieces of equipment carried and protect the technological equipment required in the modern battlefield. Integrating the LCE frame with the electronics allows for weight optimization of the LCE system.

Flex joints may be molded into the LCE frame parallel to the wearer's shoulder blades which allows the upper portion of the frame to move with the wearer's shoulders for enhancing the range of motion in the shoulder and the lower back of the wearer's thereby providing increased mobility to the soldier as required by the terrain and conditions being traversed. The flexible frame of the LCE has a smooth surface that conforms to the wearer's back, is light weight and allows the LCE load to remain close to the back.

The LCE frame also provides an adjustment device for controlling the frame adjustment mechanism which provides a height adjustment between the waist belt and frame so that the LCE frame may fit a wide range of wearer sizes. The waist belt extends across the wearer's back at the waist and hip level and may be attached to the LCE frame adjustment mechanism at various mounting points for additional adjustment between the waist belt and frame so that a single LCE can accommodate most every wearer regardless of gender or size (i.e., 1st percentile female to the 99th percentile male of military sizing).

In addition to adjusting the distance between the waist belt and LCE frame, which effectively changes the height of the LCE, the same frame adjustment device automatically simultaneously adjusts the length of the shoulder and rib-cage straps to the wearer's body. The shoulder and rib-cage straps are anchored to the LCE frame adjustment mechanism so that the wearer can simultaneously adjust the rib-cage straps, shoulder straps and waist belt height of the LCE allowing the wearer to distribute the pack load supporting from 20% to 80% between the shoulder to the waist thereby providing enhanced comfort and mobility due to the load distribution thereon. The LCE frame adjustment mechanism also provides quick adjustments as different clothing options such as body armor, chemical suits, or cold weather gear are added to one's basic size.

The LCE, in accordance with the present invention also provides a single point release mechanism as a means of doffing the wearers LCE load quickly and safely. The release mechanism includes a tension compensation cable which when activated releases the multiple attachment points simultaneously thereby releasing the LCE load clear of the pack frame when the wearer is standing, sitting or laying prone. Removal of the LCE load independent of the LCE frame, restores maximum mobility to the soldier without having to remove the LCE frame. The result of the present invention is a functional, comfortable modular system that provides the soldier with maximum mission capabilities.

For further understanding of the present invention and its features and advantages, attention is directed to the drawings and the following brief description thereof, which constitute a detailed description of a presently preferred embodiment of the invention.

DETAILED DESCRIPTION OF PRESENTLY PREFERRED EMBODIMENTS OF THE INVENTION

Figure 1:
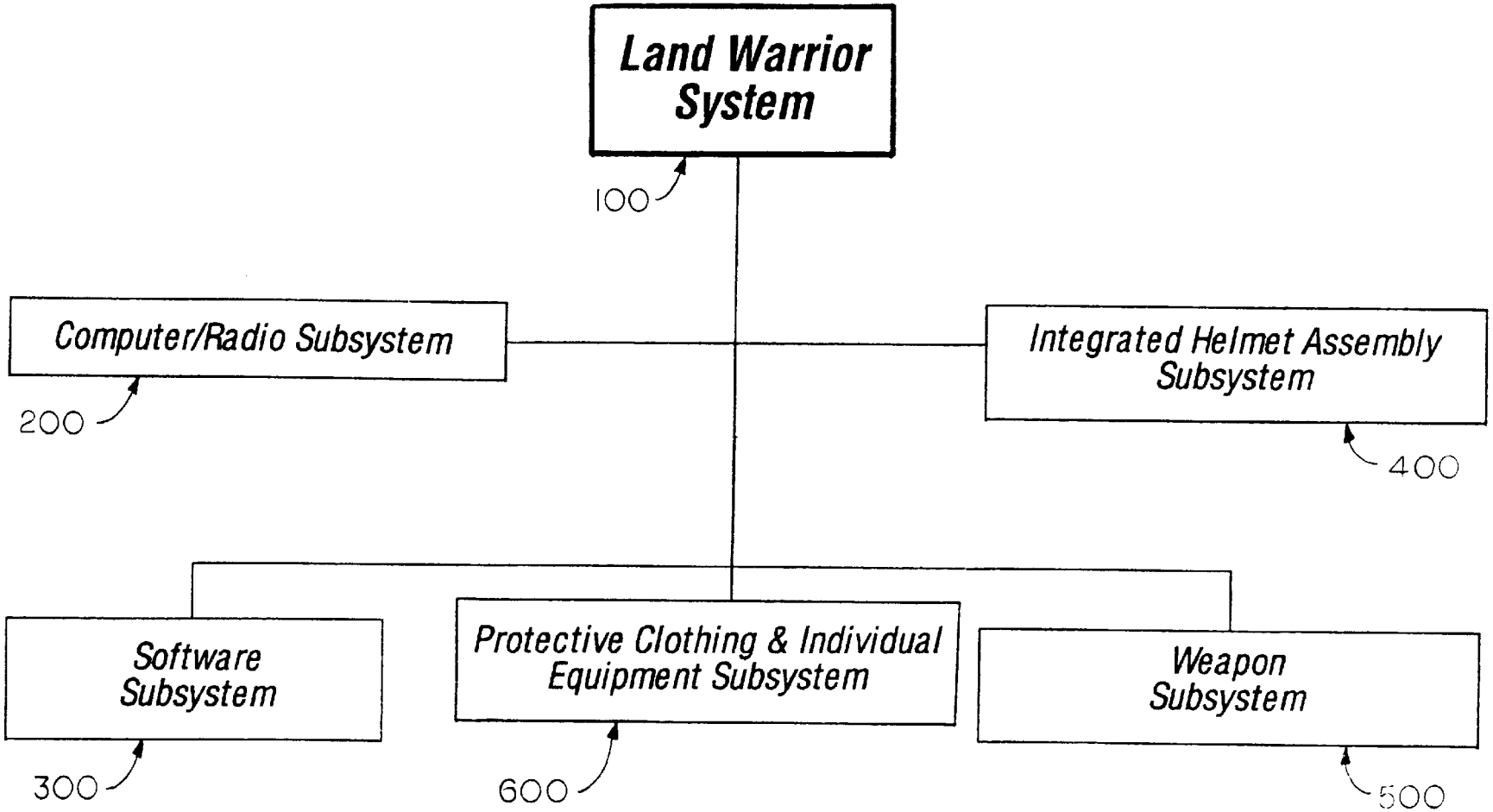
FIG. 1 is a block diagram of a Land Warrior (LW) system in which the modular load carrying equipment forms an integral part of the protective clothing and individual equipment subsystem.

Referring now to FIG. 1, there is shown a block diagram illustrating a Land Warrior (LW) system and related subsystems. One subsystem is the Protective Clothing and Individual Equipment subsystem, of which the LCE forms an integral part. The LW system may be worn by the soldier, via the LCE, during day-to-day military operations to increase individual soldier effectiveness through the integration of multiple technical subsystems including: a Computer/Radio Subsystem (CRS) 200; a Weapon Subsystem (WS) 500; an Integrated Helmet Assembly Subsystem (IHAS) 400; a Protective Clothing and Individual Equipment Subsystem (PCIES) 600; and, LW Software Subsystem (LWSS) 300.

Figure 2:
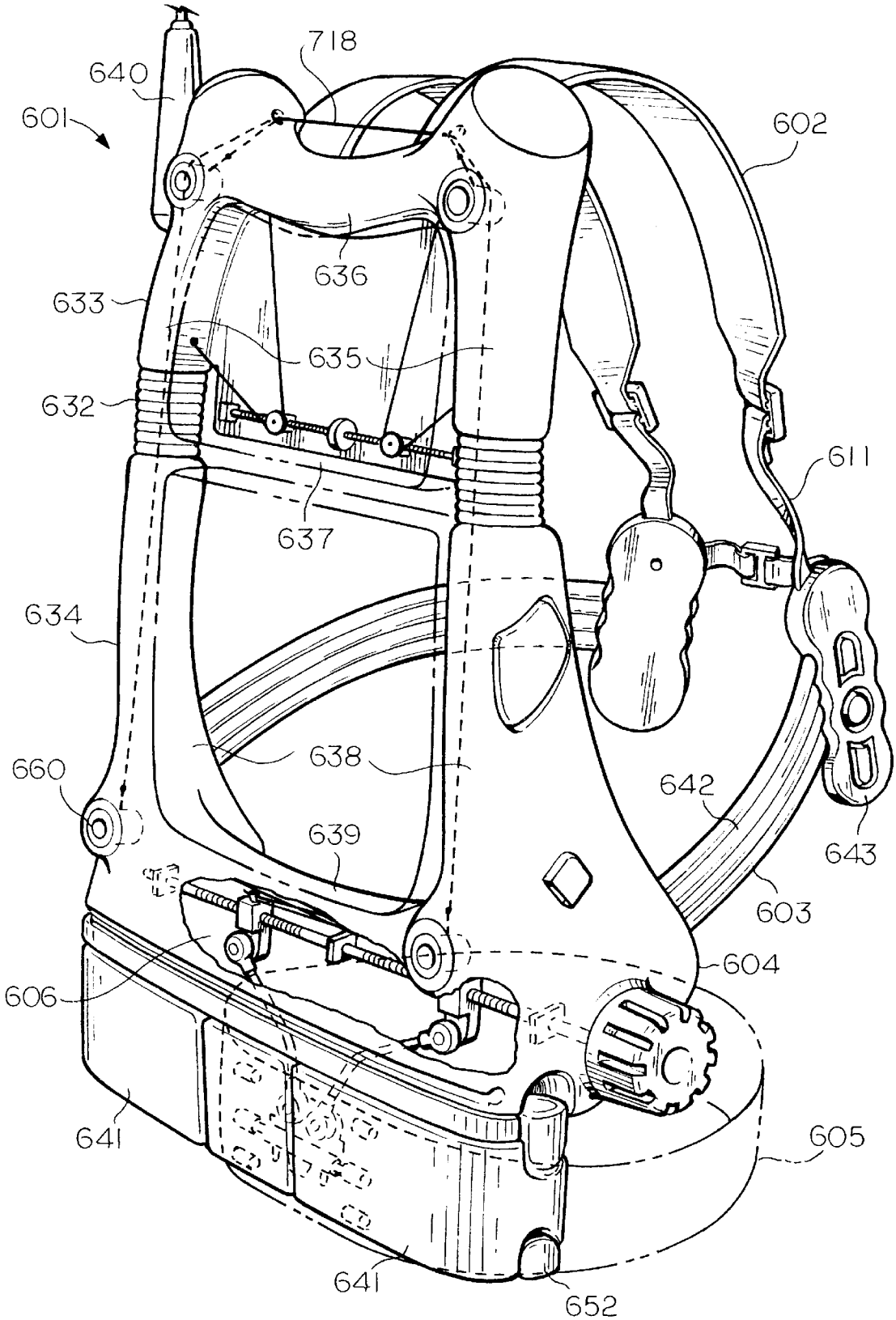
FIG. 2 is a perspective view of a backpack frame of the LCE according to a preferred embodiment of the present invention, employing a system for adjusting the length of shoulder straps, rib-cage straps and waist belt support of the backpack frame.
Figure 5:
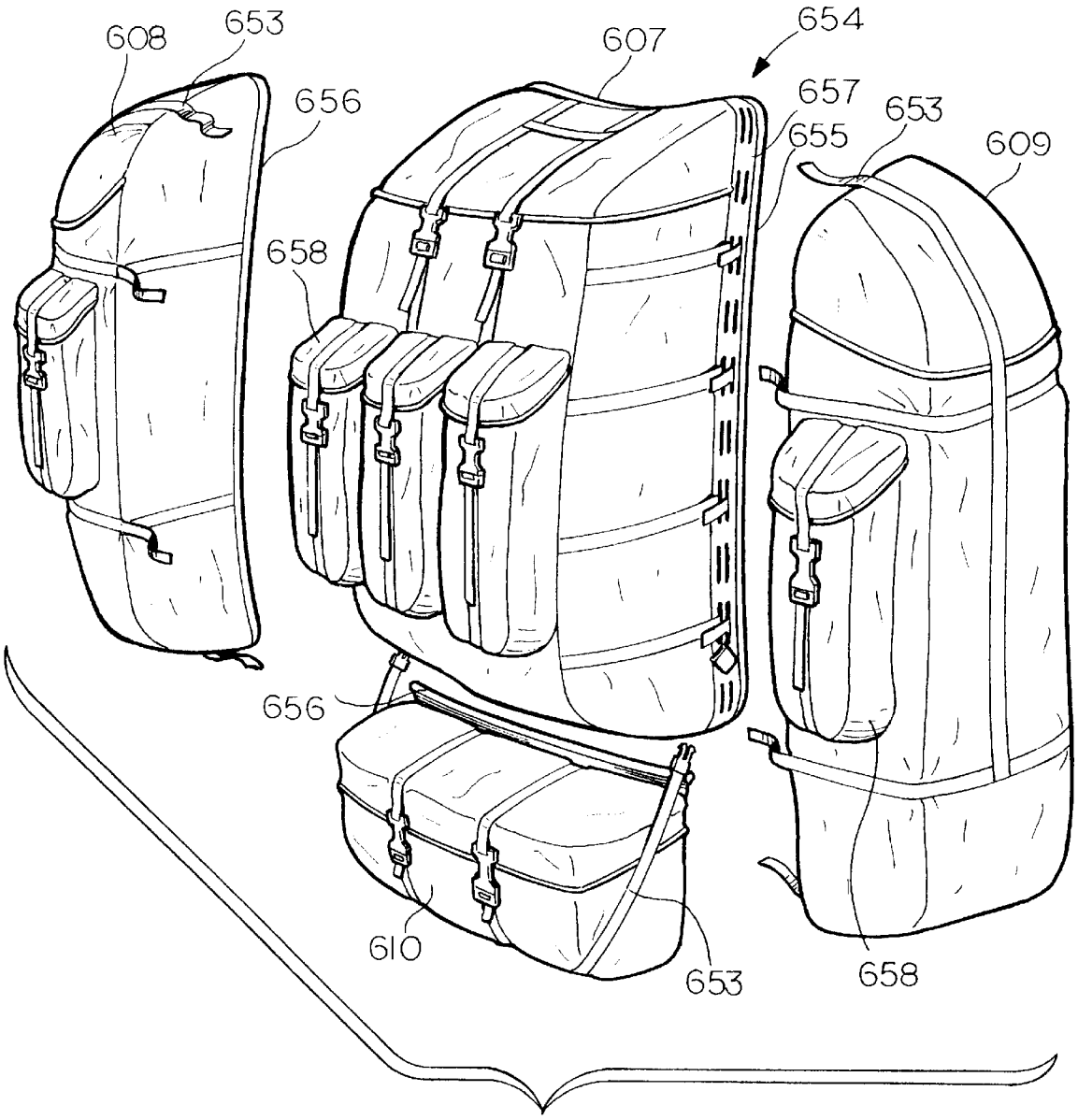
FIG. 5 is a perspective view of the modular load packs which may be used with the backpack frame illustrated in FIG. 2.
Figure 6:
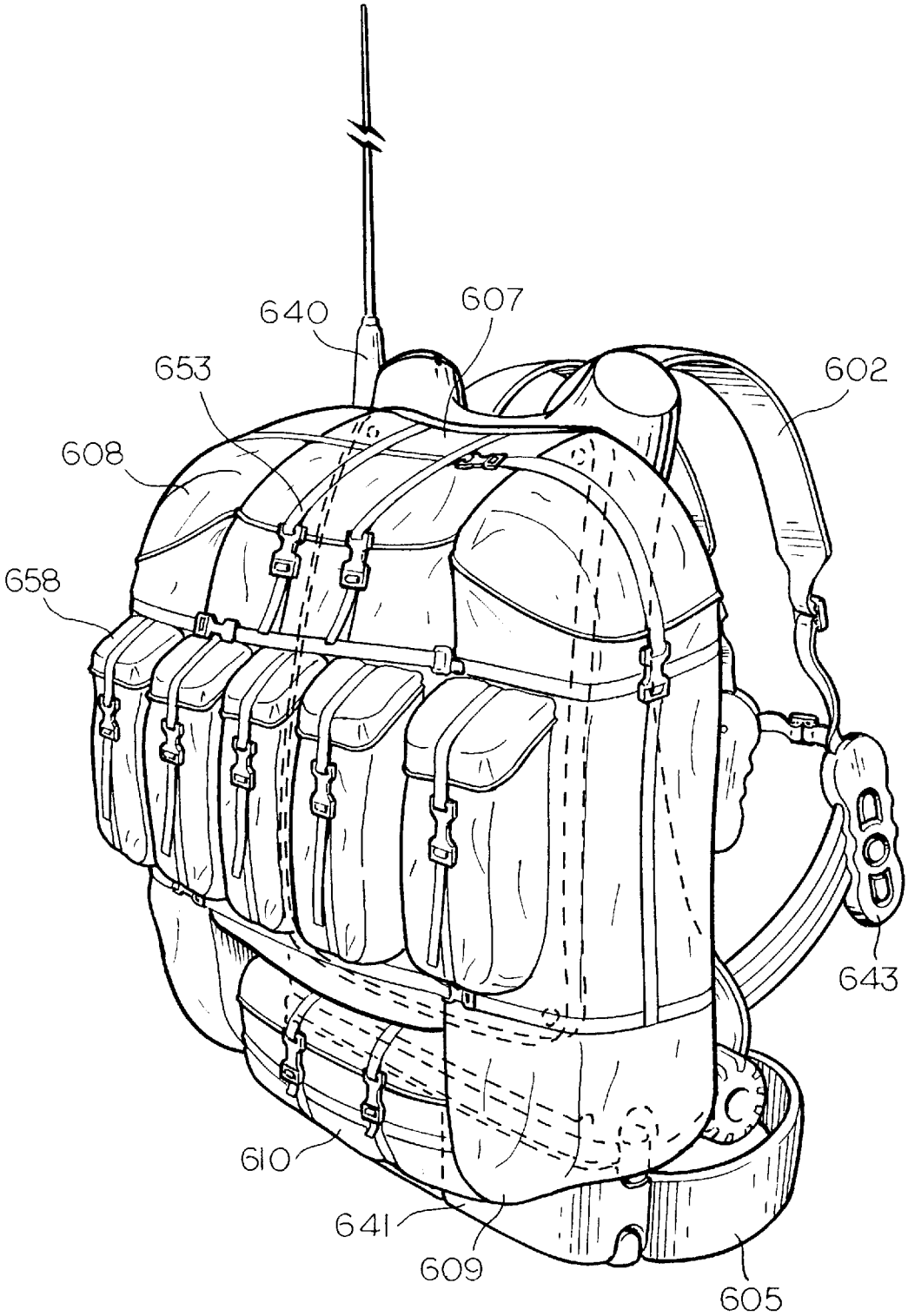
FIG. 6 is a perspective view of the modular load packs attached to the pack frame illustrated in FIGS. 2 and 3.

Reference is now made to FIGS. 2 & 6, which generally illustrates an LCE 601. The LCE 601 generally includes a pair of upper load carrying shoulder support straps 602 and/or rib-cage straps 603; a pack frame 604, a waist belt 605, a frame and strap adjustment mechanism 606 and multiple modular load packs 607 through 610 (see, FIG. 5) attachable to the LCE 601. The inside of waist belt 605, rib-cage straps 603 and underside of shoulder straps 602 are preferably padded with a resilient material such as foam. Waist belt 605, rib-cage straps 603, and shoulder support straps 602 wrap around the waist and shoulders respectively to distribute the load efficiently and comfortably.

It will be appreciated that the pack frame 604, rib-cage straps 603 and waist belt 605 serve multiple functions. The pack frame 604 functions as an articulated protective housing for the LW subsystems and wiring harnesses; a platform for antennas, battery boxes and connectors; and a quick release and load transfer mechanism for the pack load being carried. The rib-cage straps 603 function as a tension support strap in addition to functioning as a durable conduit for protecting the LW wiring. Finally, the waist belt 605 incorporates ballistic protection and functions to support the lower back of the wearer.

Figure 3:
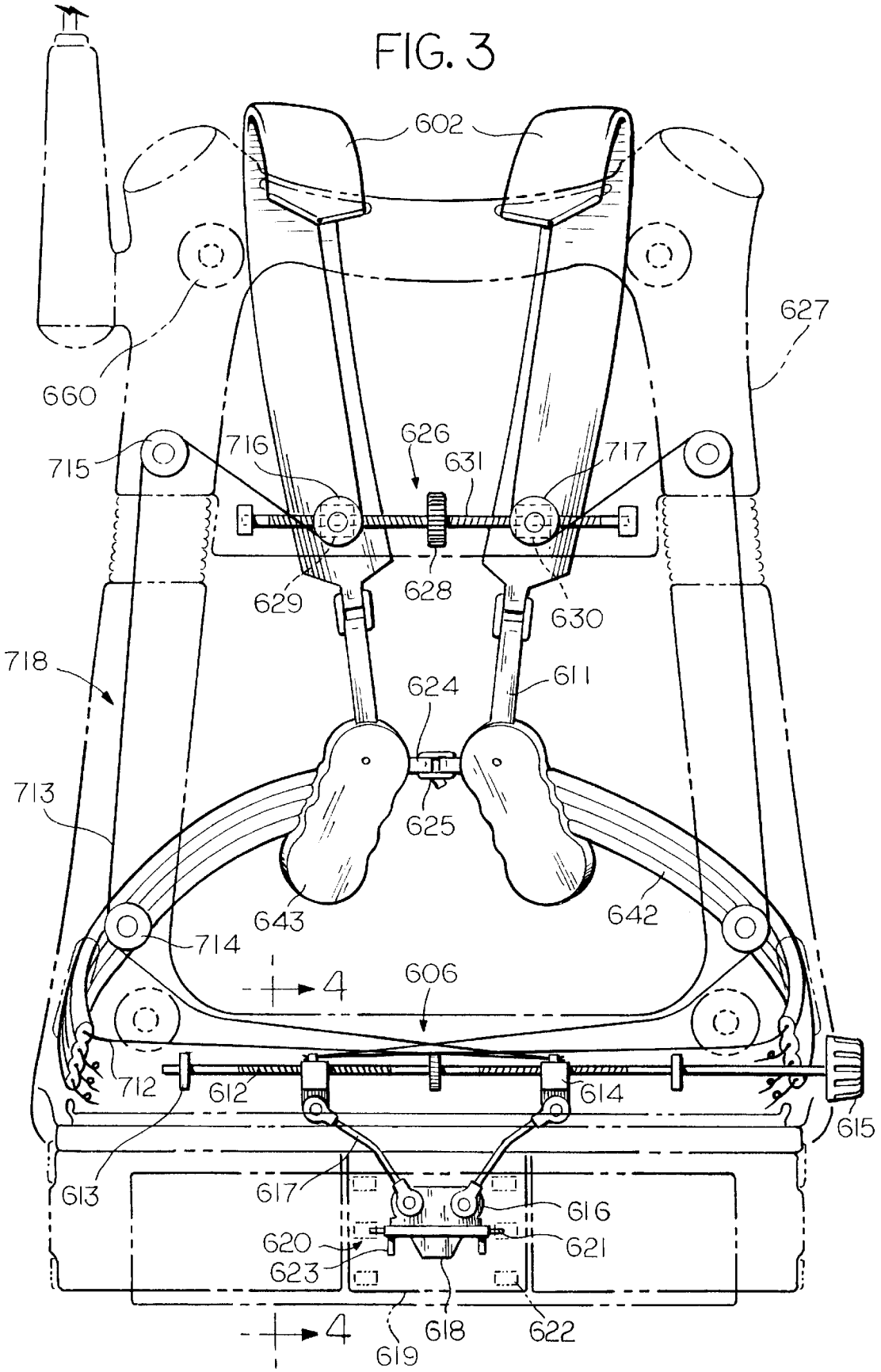
FIG. 3 is a rear view of the backpack of FIG. 2, illustrating a shoulder, rib-cage, and waist belt support adjustment system in accordance with the present invention.
Figure 3A:
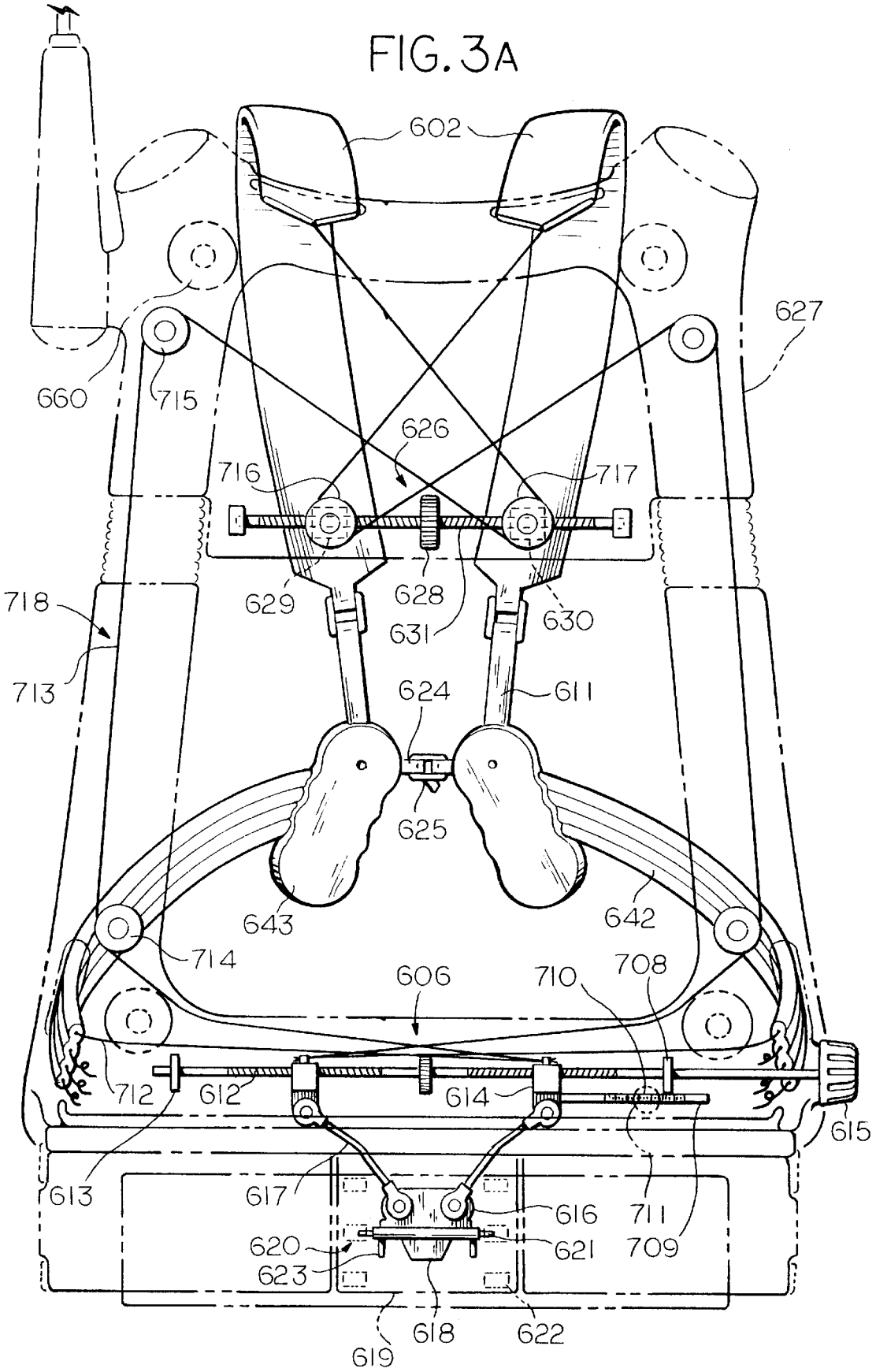
FIG. 3A is a rear view of an alternate embodiment of the backpack of FIG. 2, illustrating a backpack frame adjustment window and a pulley system.

The shoulder straps 602, rib-cage straps 603 and waist belt 605 may be attached to the pack frame 604 by way of an adjustment mechanism 606 and pulley system shown generally in FIGS. 3 and 3A. The adjustment mechanism 606 is connected through suitable brackets 613 to the lowermost end of the pack frame 604. The adjustment mechanism 606 may be enclosed within a rubber boot or housing (not shown). The housing is, in turn, fixedly supported to the pack frame 604. The housing acts to protect the adjustment mechanism 606 to minimize damage thereto.

The adjustment mechanism includes a LH/RH threaded drive screw member 612 is supported for rotation within brackets 613, as seen in FIG. 3. A pair of traverse brackets 614 are mated with the driving screw 612 and is attached to the free ends of the shoulder straps 602 and rib-cage straps 603 through a cable and pulley mechanism within said pack frame 604.

The pulley system provides the operative connection between the adjustment mechanism and the support straps by, for example, attaching left cable 712 to traverse bracket 614 located on the right side of the pack frame and to the free end of the left rib-cage strap 642. Cable 713 is attached to the same right traverse bracket 614 and is manually manipulated along the left side of the pack frame by pulley 714 and 715. From pulley 715, cable 713 can be routed around pulley 716 or 717 (as shown in FIG. 3A) as desired and attached to the free end of the left shoulder strap 602 which fastens over the shoulder of the wearer.

The outer most end of the drive screw 612 of the adjustment mechanism is drivably connected to a suitable adjustment devise such as a rotatable lever or knob 615 and the like. When knob 615 is rotated in a given direction, the drive screw 612 is activated, and brackets 614 are driven either inwardly or outwardly from the center line of the pack frame 604 pulling or releasing the tension on the cables which are attached to the shoulder straps 602 and rib-cage straps 603 thereby respectively expanding or contracting the straps around the wearer's torso. Ladder locks 611 of a type well known in the art, associated with each of the shoulder straps 602 permit further adjustment of the length of the straps to suit the wearer.

In a preferred embodiment of the invention, FIG. 3A shows a pack frame adjustment window 707. Adjustment window 707 includes a bracket 708 slidably connected to the drive screw 612. A cross piece 709 is adjustably affixed to bracket 708 and bracket 614 to secure the cross piece 709 in a desired fixed position. The cross piece 709 may be affixed to the brackets 708 and 614 by, for example, forming a threaded opening in brackets 708 and 614 into which the cross piece 709 may be adapted to fit. The cross piece 709, may be adjusted by merely rotating the cross piece to provide an incremental movement left or right as desired.

The cross piece 709 includes a plurality of position marks 710 along its length which may be viewed through a transparent window 711 affixed to the pack frame 604. The marks 710 may be used to indicate the adjusted size of the pack frame 604 to provide a quick view of the pack frame size before placing the pack on the wearer's back.

The waist belt 605 is interconnected with the movable brackets 614 through a linkage mechanism indicated generally at 616. Linkage mechanism 616 includes a pair of links 617 pivotally connected to belt block bracket 618. The other ends of links 617 are pivotally connected through suitable mechanical interconnection to movable brackets 614. The ends of links 617 may include ball rod end joints, of a type well known in the art, to allow for load transmitting and a wide range of motion between the upper body and hips of the wearer. Links 617 may be a shock absorbing link or sculpted washers may be used with links 617 so as to at least partially absorb shocks or restrain the range of motion of the links caused by shifting of the weight of the backpack load sideways or twisting of the waist belt 605.

The belt block bracket 618 is fixed to a receiver plate 619 through an engagement mechanism 620. The engagement mechanism 620 generally includes spring loaded slide pins 621 adapted to engage with mounting points 622 of receiver plate 619 upon which waist belt 605 is supported. The slide pins 621 may be disengaged for re-positioning of the waist belt 605 along a multitude of waist belt mounting points 622 by suitable means such as pin tabs 623 and the like.

A feature of the waist belt engagement mechanism 620 is that compensation for the gross fitting definitions of the Army sizing (short, regular, long), for clothing are accomplished by the mounting points 622 on the waist belt 605. For example, a "regular" build person would attach at the middle mounting point 622, a "long" would attach in the upper mounting point and a "short" in the lower mounting point. It will be appreciated that additional waist belt mounting points can be added for greater range of distance between the pack frame 604 and the waist belt 605.

As viewed in FIG. 3, as the drive screw is rotated by movement of the knob 615 to expand the shoulder straps 602 and rib-cage straps 603, the traverse brackets 614 are driven inwardly and, in so doing, also causes the links 617 to rotate to a generally vertical position thereby expanding the length between the backpack frame 604 and the waist belt 605 while the LCE backpack 601 is being worn by the user. When the user wishes to shorten the length of the backpack frame 605, drive screw 612 is rotated in the opposite direction causing the traverse brackets 614 to move outwardly which in turn causes the links 617 to rotate to a generally horizontal position and thereby shorten the length between the waist belt 605 and pack frame 604 effectively changing the length of the pack frame 604. The ability to simultaneously change the length of the frame, shoulder straps 602, and rib-cage straps 603 allows the wearer to selectively transfer the LCE load between the hips and the shoulders while on the move to gain instant relief from muscle fatigue caused by carrying all the weight of the pack with one muscle group. To keep the shoulder straps 602 and rib-cage straps 603 from spreading to the outside of the wearer's body, a sternum strap 624 may be attached to each of the shoulder straps 602 and fastened together by means of a quick release buckle 625, such as a quick release buckle commercially available. A similar quick release buckle, not shown, may also be used to fasten the waist belt 605 around the hip and waist of the wearer. The adjustment mechanism also provides infinite proportional adjustment within the adjustment range.

It should be appreciated that the shortening of the pack frame height to the waist belt 605 while simultaneously shortening the shoulder 602 and rib-cage straps 603 places increasing load on the wearer's shoulders until the links 617 ultimately lifts up the waist belt 605 shifting the load to the wearer's shoulders, the opposite load shifting occurs by lengthening the height of the pack frame 604.

The angle of the shoulder straps 602 may be further adjusted by movement of the upper gear mechanism 626 secured within the upper frame module 627 of the pack frame 604. The upper gear mechanism 626 includes a control knob 628 and pulley support portions 629 and 630 through which the horizontal screw rod 631 extends. The teeth of the pulley support portions 629 and 630 are engaged with the toothed portions of the screw rod 631 so that rotation of the screw rod 631, via control knob 628, causes lateral transverse movement of the support portion 629 and 630, and of the respective connected shoulder straps 602. Further, the gear ratios between screw rod 631 and both of the support portions 629, 630 are equal so that the shoulder pads 602 will move an equal distance inwardly toward the longitudinal center line of the pack frame 604 when the control knob 628 is rotated in the clockwise direction and an equal distance outwardly therefrom when rotated in the counter clockwise direction.

With the aforedescribed arrangement, adjustment required around the shoulder and rib-cage, and adjustment between the shoulder and waist belt distance may be effected without having to remove the LCE backpack 601. The combination of the adjustment mechanism 606 and mounting points 622 provides the necessary adjustment so that a single LCE backpack 601 can accommodate the 1st percentile female to the 99th percentile male user. Furthermore, the adjustment mechanism 606 provides rapid re-distribution of a load carried via the shoulders through the spine to the pelvis to a load carried directly to the pelvis via the waist belt accommodating the wearer's body size and mission requirements, clothing layer and mission requirements.

Referring now particularly to FIG. 2, the backpack frame 604 includes flex points 632 between the upper LCE module 633 and the lower LCE module 634. The upper LCE module 633 includes vertical support members 635 which are connected at their upper end by the upper horizontal support member 636. The upper frame module further includes a contoured backplane surface 637 extending between the support members 635,636. The lower frame module 634 is similar to the upper frame module 633 except that it is inverted with lower vertical support members 638 connected to the lower horizontal support member 639 where the adjustment mechanism 606 is mounted. The flex points 632 allow the upper frame module 633 to move with the wearer's shoulder axis while on the move instead of being fixed with the lower frame module 634. This flexibility of design permits a body-hugging anatomically designed pack frame to give the wearer a comfortable fit and stability through shaping of the frame, rather than merely adding padding to the frame thereby extending the wearer's level of comfort and range of motion.

The support members 635–636, 638–639 serve as mounts for the LW Computer/Radio subsystem (CRS) 200/Software Subsystem (LWSS) 300 previously described, and multiple modular load packs 607 through 610 as described in more detail below in conjunction with FIG. 5. These support members may be made of reinforced thermoplastic materials for housing the support straps 602, 603 and other peripheral items such as the radio and Global Positioning antennas 640, battery boxes 641, and wiring 642 which extend within the pack frame 604 and rib-cage straps 603 to front connector boxes 643. The LCE backpack 601 includes an integrated wiring system which can accommodate an optional redundant wiring harness for the IHAS, input devices and Weapon System as, for example, an optional backup wiring system in the event of damage to one side of the wiring harness thereby allowing the wearer to switch to the other connector box 643 and remain a part of the digital battlefield. The integrated design of the frame 604 allows for weight optimization of the LW system and provides a platform for easy insertion of current and new components in the frame while allowing the frame to twist, flex and easily adjust.

Figure 4:
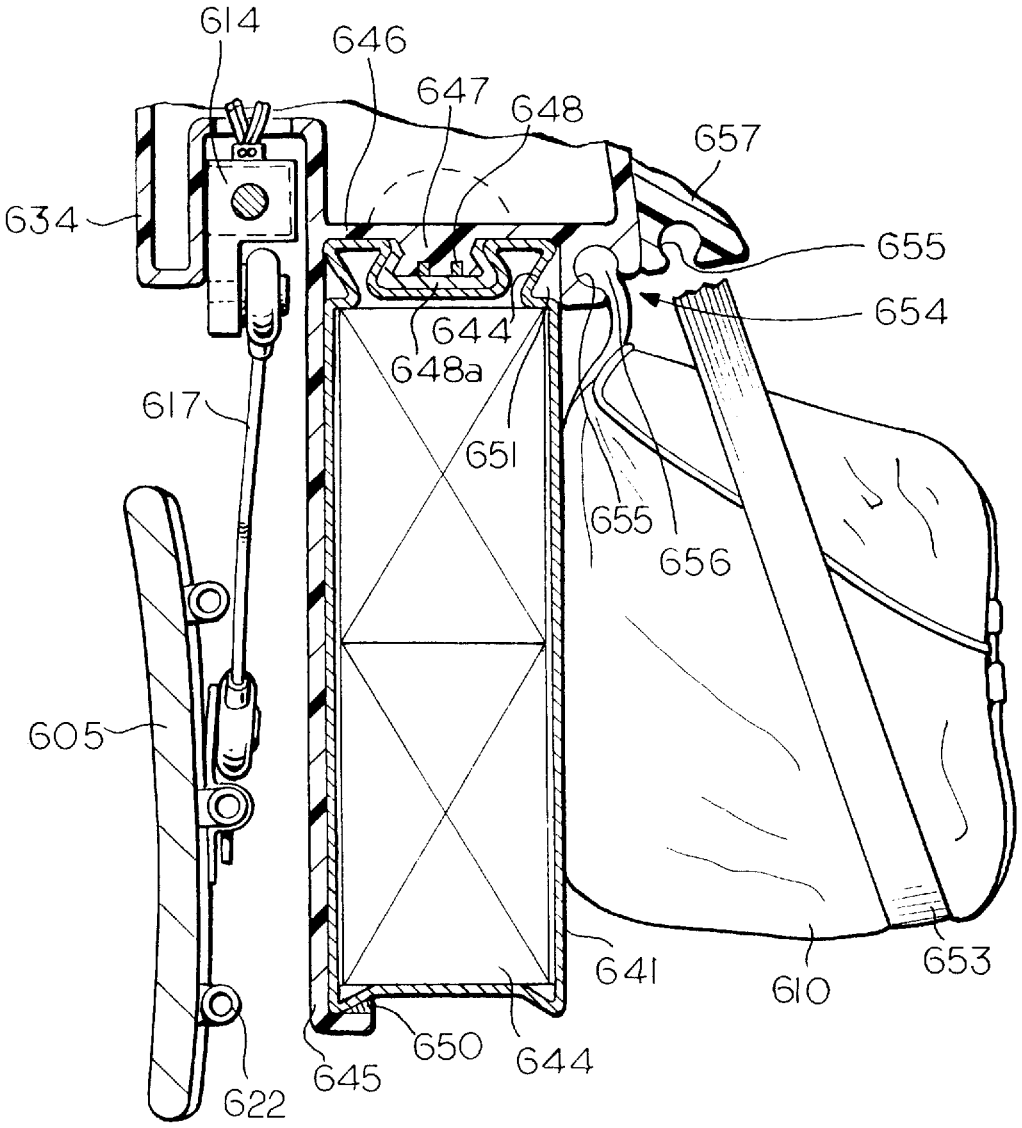
FIG. 4 is an enlarged cross-sectional side view of a track mounted battery assembly and pack load sealing joint taken along line 4—4 of FIG. 5, and further illustrating various options of attaching an assault pack to either the pack frame or an approach pack module.

As illustrated in detail in FIG. 4, main power batteries 644 of the LW system may attach to the lower horizontal support member 639 in slide in/out battery boxes 641. Extending from support member 639 is a generally L-shaped frame 645 having disposed adjacent links 617 within which battery boxes 641 are slidably supported. The upper side of frame 645 includes a downwardly opening channel portion 646 having a downwardly extending dovetail tenon 647 within which electrical connectors 648 are attached. The upper most end of battery boxes 641 include detail mortises 649 for interlocking engagement with the tenon 647. The tenon 647 and mortises 649 define a longitudinal extending dovetail type slot within which battery boxes 641 are slidably supported. The mortises 649 include protruding connector pins for providing conductive contact between batteries 644 and connectors 648 as the battery boxes 641 move over the connector-bearing end of the tenon 647. Installation of the battery boxes 641 is assisted by means of inner guide elements 650 and 651 disposed within the open ends of frame 645.

Spring-loaded contact shield members 648A are used to cover the connector pins and battery pins until just before the connectors 648 and the pins are fully mated. The fully mated condition provides conductive continuity from batteries 644 to the electrical components within pack frame 604. To assure the battery boxes 641 are secured in the fully mated position, spring-loaded latch members 652 (FIG. 2) are provided at the upper and lower most end of each battery box 641 to matingly engage and connect with a corresponding slot (not shown) formed in the side of frame 645. Latch members 652 include an exterior surface which is appropriately gnarled or embossed to enable easy grasping and manipulation by the wearer. When a battery box 641 is removed from the frame 645, for example, for repair and the like, both latch members 652 on the battery box to be removed are depressed. It will be appreciated that by requiring depression of both latch members 652 of each battery box, eliminates inadvertent release of the battery boxes 641.

Reference is now made to FIG. 5–6 in which the modular components of the LCE backpack 601 are further depicted. The versatile, large capacity LCE system includes an assault pack 610, approach pack 607, and sustainment packs 608, 609 each of which may be constructed of various materials such as Nylon and high density packcloth with bound seams. The pack system can be worn in various configurations ranging from none to all of the packs allowing the wearer to tailor the load, weight and distribution of the equipment being carried. This flexible design also allows for removal, replacement, repair and exchange of damaged equipment.

As illustrated in FIG. 6, the sustainment packs 608, 609 are attached in two modules to the left side and right side of the approach pack 607 with compression/attachment straps 653 with quick release buckles. The assault pack 610 also incorporates compression/attachment straps and may be attached to the approach pack 607 or to the waist belt 605 as a waist pack (see also, FIG. 4). As shown in FIGS. 4 and 5, the packs include a strip seal joint 654 for interconnecting the packs. The seal joint 654 is made up of generally C-shaped elongated rails 655 and support element 656. The rails 655 are molded within the lower horizontal support member 639 of pack frame 604 and around the periphery of the approach pack backplane 657. The support element 656 are formed along and extend outwardly from the pack seams and is complementary in shape to the cross section of the rails 655 so that it may be retained within the rails 655.

The modular load packs 607–610 are formed of multiple individual compartments with internal straps, preventing load settling or shifting. The packs may include storage pouches 658 for ammunition and other small items with silent closures of a type well known in the art to maintain noise discipline and ready access to stored items. The approach pack backplane 657 is preferably constructed to keep hard or irregular shaped items from protruding from the LCE into the back of the wearer. Attachment points on the outside of the approach pack 606 enable additional equipment (e.g., water, ammo, mortar rounds, etc.) to be attached to the pack with standard military slide clips, cords or the like. Adjustable stays 653 anchor the modular load packs 607–610 forward on the pack frame 604 and waist belt 605, distributing the load forward on the lumbar/hip area for a comfortable, stable transference of load. By tightening the load packs 607–610 closer to the body, the LCE backpack 601 provides (1) a low profile backpack allowing the soldier to crawl on his back (an essential maneuver when crossing under a low obstacle) and (2) closer positioning of the center of gravity to the center of gravity of the wearer's body thereby providing a comfortable method of carrying heavy loads with reduced fatigue.

The above described backplane 657 of the approach pack 607 carries spaced apart male coupling elements 659 (FIG. 7–9) which disengageably couple with a spaced apart female coupling element 660 of the pack frame 604. Each pair of the coupling elements 659 and 660, as described more fully herein, form a quick disconnect coupling mechanism 661. The quick disconnect feature of the coupling 661 being important in reducing the time involved in doffing the soldier's load quickly and safely.

Figure 7:
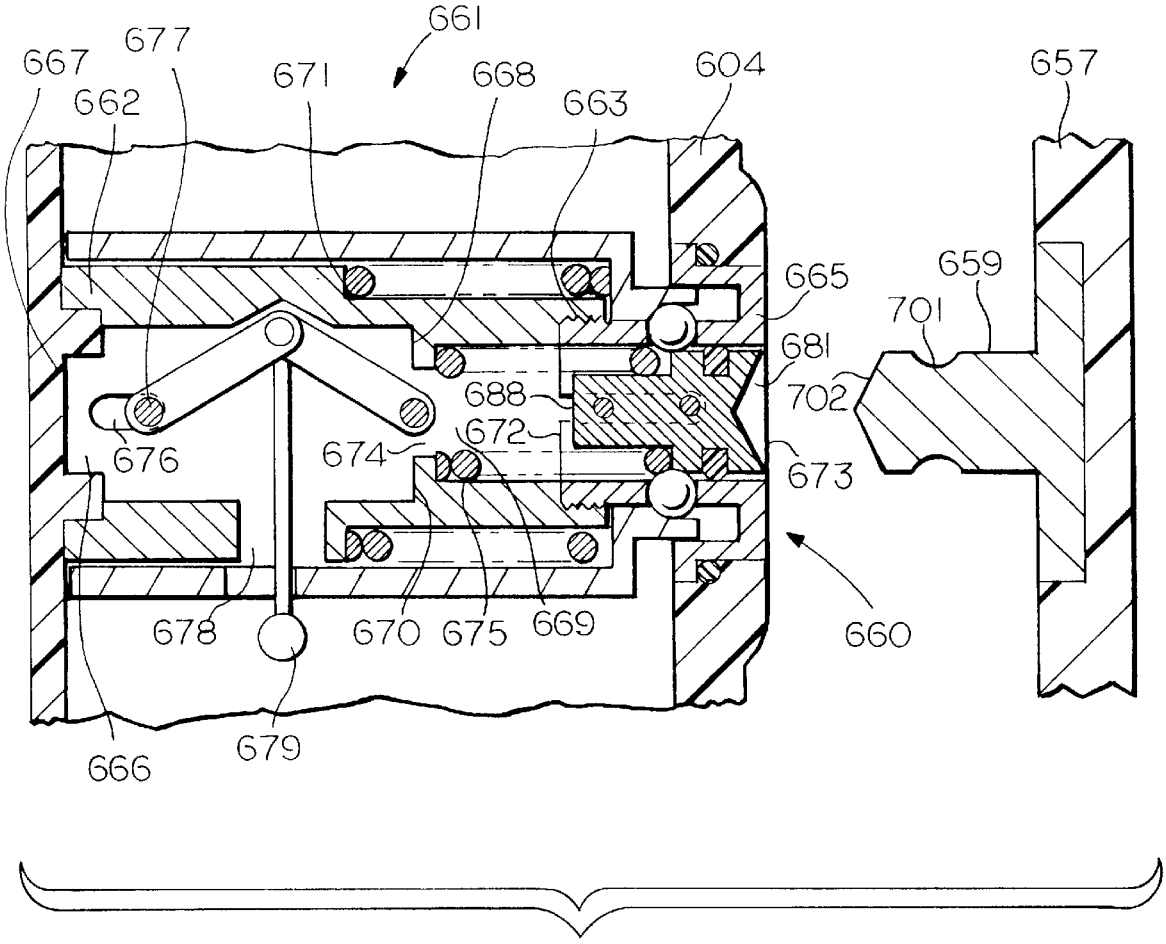
FIGS. 7–9 are enlarged partial cross-sectional views of the pack frame and approach pack module of FIG. 2, illustrating the quick release mechanism for releasing the pack load from the backpack frame.
Figure 8:
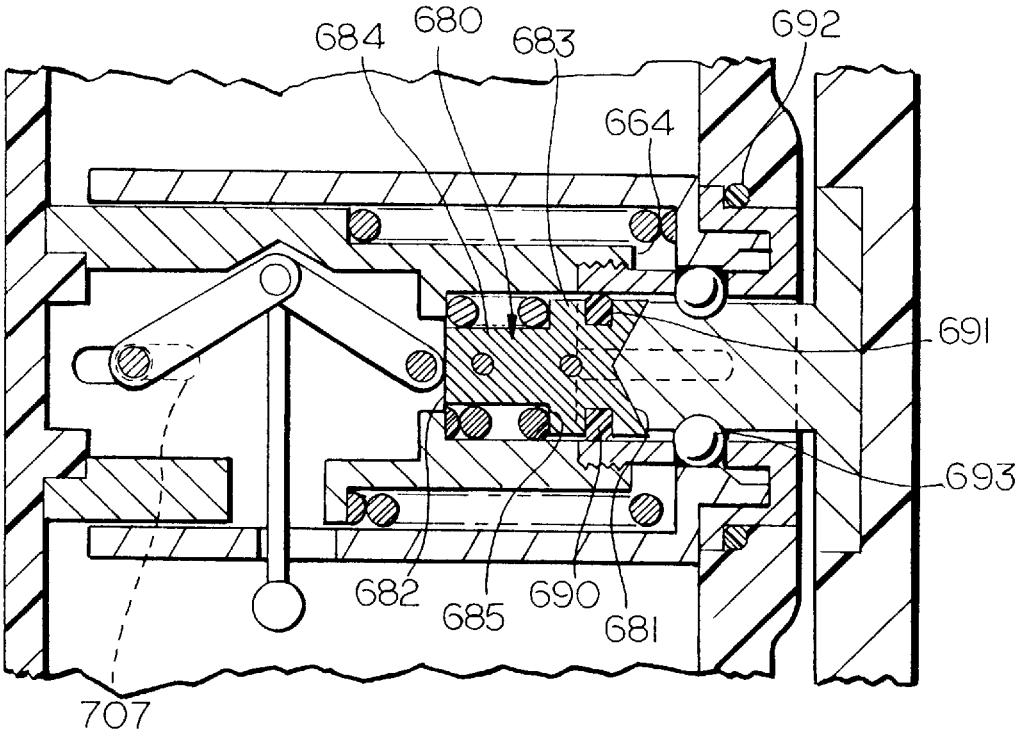
Figure 9:
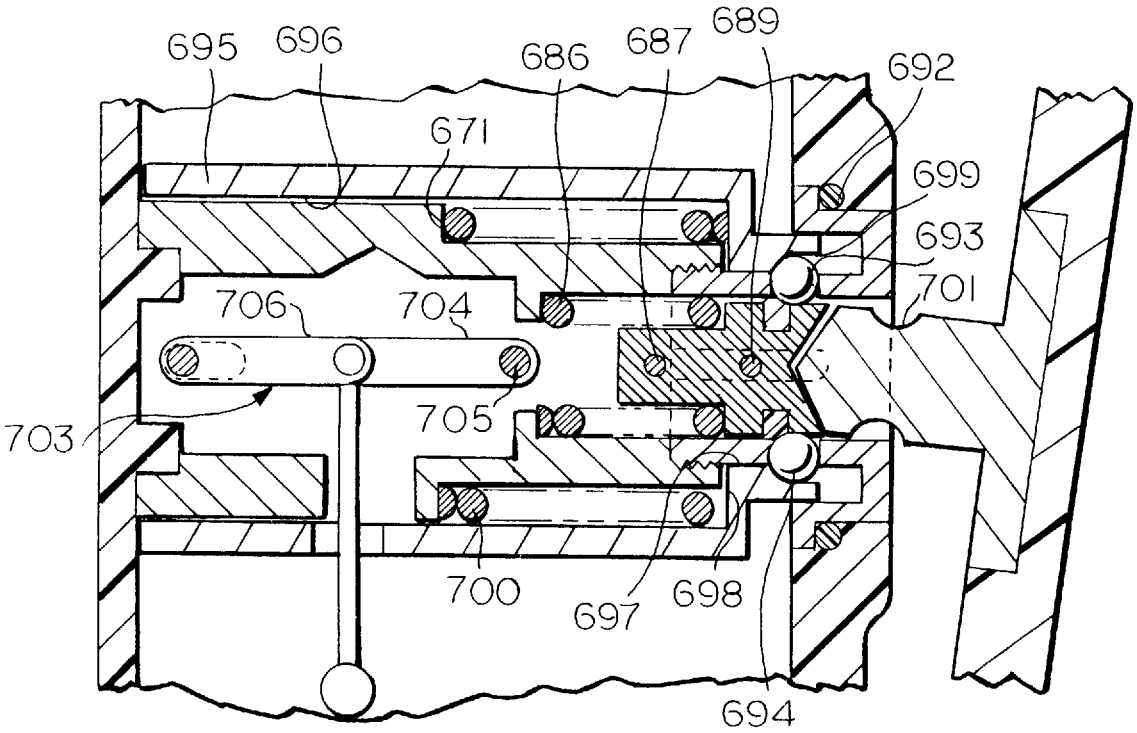

As shown in FIG. 7–9, the female coupling element 660 of the quick disconnect coupling 661 is affixed within the pack frame 604 and is made up of a metallic annular member 662 with an internally threaded portion 663 at its upstream end 664 to be threadably secured to fitting 665. The annular member 662 has a larger internal and external diameter portion 666 which extends from its downstream end 667 partly toward its upstream end 668, and further has a reduced internal and external diameter portion 669 which extends from the larger diameter portion 666 to the upstream end 664. As shown, the larger diameter portion 666 and the smaller diameter portion 669 form an inner annular shoulder 670 and an external annular shoulder 671 which extends transversely of the longitudinal central axis of the annular member 662. Further, as illustrated, fitting 665 has a substantially uniform internal diameter which extends between its inner end 672 and its outer end 673 and is substantially the same as the internal diameter of smaller portion 669.

The annular member 662 includes a restricted opening portion 674 between the large diameter portion 666 and smaller portion 669, the restricted portion 665 and the smaller internal diameter portion 669 forming an annular shoulder 675 which also extends transversely of the longitudinal central axis of the annular member 662. The annular member 662 also includes a slot 676 formed along the longitudinal axis of and extending through the larger portion 666 dimensioned to receive pin 677. The larger portion 666 also includes a bore 678 allowing passage of tension release member 679.

The female coupling element 660 includes an annular body 680 (FIG. 7) which is slidably positioned within the smaller diameter portion 669 and the fitting 665 of the annular member 662. The annular body 680 has an end 681 which faces toward the upstream end 668 of the annular member 662, and an opposed end 682 which faces toward the downstream end 667 of the annular member 662. The annular body 680 ha a larger diameter portion 683 which extends from the end 681 partly to the end 682 and a smaller diameter portion 684 which extends from the end 682 partly to the end 681. Smaller portion 684 and larger portion 683 forming an annular shoulder portion 685 which extends transversely of the longitudinal central axis of the annular member 662.

As illustrated in FIG. 8, annular body 680 is resiliently biased outwardly (upstream) toward the end 673 of the fitting 665 by a coil compression spring 686 which is trapped between, shoulder portion 685 of annular body 680 and shoulder 675 of annular member 662. The annular body 680 is prevented from exiting the fitting 665 under the influence of the spring 682 by the bottoming of pin member 687, extending from the annular body 680, against the outer periphery of shallow channel 6813 (FIG. 7) formed in the inner surface of fitting 665 designed to slidably receive pin member 687 and 689. Notwithstanding the movability of the annular body 680 within the smaller diameter portion 669 and fitting 665, as described, fluid or debris is prevented from entering between the fitting 665 and annular body 671 by providing a conventional "O" ring seal 690 therebetween. The O-ring seal 690 is retained in an annular recess 691 found in the outer surface of the larger diameter portion 683 of the annular body 680.

An outer seal 692, which may also be a conventional "O" ring seal is provided at the interface of the fitting 665 and the inner surface of pack frame 604. The second seal 692 is positioned to prevent unwanted debris or fluid from passing into the pack frame structure. This sealing arrangement also provides means to prevent unwanted debris or fluids from entering the quick disconnect coupling mechanism 661 and thus prevent hydrostatically produced axial forces that may adversely affect breakaway de-coupling of the wearer's load pack.

Fitting 665 includes a plurality of bores or apertures 693 around the circumference of the fitting 665. Preferably, fitting 665 includes a minimum of three apertures disposed in equal, spaced-apart relation around fitting 665. Each aperture 693 receives a coupling ball member 694 to define an outer set of coupling balls. The aperture 693 may be inwardly tapered to an extent such that coupling balls 694 cannot pass inwardly into the center aperture of the fitting 665, but otherwise are freely movable therein.

As shown in FIG. 8, a cylindrical outer sleeve 695 is disposed around the annular member 662 and cocentric therewith. The outer sleeve 695 has a larger diameter portion 696 and a reduced internal diameter portion 697 which are closely received, in relatively tight but sliding relation thereto, about the larger diameter portion 666 and the outer diameter of the fitting 665, respectively. The larger portion 666 and reduced portion 697 form an annular shoulder 698 which extends transversely of the longitudinal central axis of the annular member 662.

The inner surface of the reduced diameter portion 697 includes shallow grooves 699 formed on the upstream end of portion 697. The grooves 699 preferably extend around the inner periphery of portion 697, and are designed to receive the coupling balls 694, as will be described herein in more detail.

The outer sleeve is biased outwardly (upstream) toward the end 673 of the fitting 665 by a coil compression spring 700 which is trapped between shoulder portion 671 of annular member 662 and shoulder 698 of outer sleeve 687. A fitting 665 and end 668 of annular member 662 act to retain the sleeve 695 within the coupling mechanism 661.

The male coupling member 659 is embedded in the approach pack's backplane 657 and provides an alignment means suitable for direct attachment of the soldier's packs to the pack frame 604. The male member 659 further includes an annular recess 701 of sufficient size to accept the coupling balls 694 when the male member 659 is fully installed, and a tapered end portion 702 which snugly seats within a mating recess formed at end 681 of annular body 680.

In the connected position, as illustrated in FIG. 8, male member 659 is inserted within fitting 665 axially retracting (downstream) the annular body 680 against its bias. In so doing, annular body 680 moves away from the bores 693 allowing the coupling balls 694 to move radially inward against the annular recess 701 on the male member 659. Accordingly, the reduced portion 697 of the outer sleeve 695 moves outwardly (upstream) over coupling balls 694 to prevent the coupling balls from moving radially outward thereby retaining the male member 659 within the female coupling element 660.

A release mechanism, indicated generally at 703, is supported within the larger diameter portion 666 of the annular member 662. The release mechanism 703 includes a first pivot arm 704 pivotally attached to the interior surface of larger diameter portion 666 at pivot pin 705. The release mechanism 703 further includes a second transverse arm 706 having a first end and second end. The first end of arm 706 is pivotally attached to the free end of pivot arm 704 and the second end of arm 706 is slidably retained within the longitudinal groove 676 of annular member 662 by pin member 677. Pin member 677 engages groove 707 of outer sleeve 695 to axially retract (move downstream) shoulder 698 of the outer sleeve 695 against end 668 of the annular member 662 when tension release member 679 is activated to rotate pivot arm 704 counter-clockwise. The coupling balls 694 are then released from annular recess 701 allowing the annular body 680 to be biased outward (upstream) from the annular member 662 by spring 682, which urges the male member 659 out of the female coupling element 660. The coupler socket is thereby returned to a "cocked" condition upon release of the male member 659 such that the coupler socket is prepared for the next connection.

As will be appreciated from the above discussion, the release mechanism 703 may be activated by most any suitable device such as a mechanical or electric means secured to the pack frame or pack frame components for actuating each pivot arm 704 simultaneously. For example, the tension release member 679 may be adapted to extend within the pack frame 604, as shown in FIG. 2, to form a single point release handle 718 located on top of the pack frame 604. With a single pull of the release handle 718, the release mechanism 703 is activated causing the pack loads to separate and drop away from the pack frame 604.

It will be appreciated that the quick disconnect coupling 661 is formed of relatively few parts. The parts forming the quick disconnect coupling 661 have primarily axial movements, which makes the coupling relatively simple and inexpensive to manufacture and assemble. Moreover, the coupling 661 is easy to use and provides a reliable quick disconnect mechanism that allows the wearer to release the pack loads when the quick disconnect coupling is activated.

The LCE 601 and its component parts may be made in most any suitable manner and of most any suitable material as required for durability and cost effectiveness. For example, the annular member 662 and fitting 665, may be molded integral with the frame 604. In the same manner coupling element 659 may be molded with the back pack backplane 657.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A human portable carrier comprising:

a frame wherein said frame is formed of a reinforced thermoplastic material adapted to the contour of the human's;

at least one item adapted to be carried by said frame;

an attachment device having one part carried on an item and a mating part carried on said frame, said parts releasably engaging with each other; and a mechanism carried on said frame and remote from said attachment device which effects disengagement of said parts.

2. A load carrying equipment, comprising:

a pack frame having an upper end and lower end;

shoulder support members arranged for fastening said pack frame about the upper body portion of a user and defining a position of attachment of said shoulder support;

rib-cage support members arranged for fastening said pack frame about the torso portion of the user and defining a position of attachment of said rib-cage support;

a waist belt arranged for fastening said pack frame about the waist of a user and defining a position of attachment of said waist belt; and an adjustment mechanism supported to said lower end of said pack frame for adjusting the position of attachment of said shoulder support, rib-cage support and waist belt so as to selectively increase and decrease the length of said shoulder support, the length of said rib-cage support and the distance between said waist belt and said lower end of said pack frame while said pack frame is being worn by the user.

3. A load carrying equipment according to claim 1, wherein said adjustment mechanism includes a knob, a screw member drivingly connected to said knob, a first device including a threaded element coacting with said screw member and operatively connected to said position of attachment of said shoulder support members and said rib-cage support members, rotation of said knob driven screw member causing the threaded members to move the position of attachments of said shoulder support members and rib-cage support members transversely of the pack frame whereby the user can simultaneously increase and decrease the length of said shoulder support and the length of said rib-cage support.

4. A load carrying equipment according to claims 3, wherein said first device includes a bracket assembly pivotally connected to and movable with said threaded element for detachably connecting said waist belt to said adjustment mechanism.

5. A load carrying equipment according to claim 4, wherein said bracket assembly includes a locking mechanism for releasably retaining said waist belt to said bracket assembly.

6. A load carrying equipment according to claim 2, wherein said waist belt includes a receiver plate attached thereto having multiple mounting points adapted to mate with said locking mechanism.

7. A load carrying equipment according to claim 2, wherein said bracket assembly is aligned on the user's lower back with the user's spine.

8. A load carrying equipment according to claim 2, further comprising a support frame extending from said lower end of said pack frame with a surface upon which is mounted a first electrical connector which is to be mated by a complementary second connector of a power cell casing for maintaining conductive contact between said power cell and said first connector, said power cell casing being adapted for sliding movement within said support frame.

9. A load carrying equipment according to claim 8, further comprising a conductive closure cooperating with said support frame for completing a conductive envelopment of said second connector whenever said power cell casing is not fully installed within said support frame.

10. A load carrying equipment, comprising:

a pack load module;

a pack frame including a lower frame module and an upper frame module wherein said modules are flexibly attached;

a quick release retention mechanism attached to said upper frame module and lower frame module for connecting said pack load module to said pack framer;

shoulder support members arranged for fastening said pack frame about the upper body portion of a user and defining a position of attachment of each of said shoulder supports;

a rib-cage support member arranged for fastening said pack frame about the torso portion of the user and defining a position of attachment of said rib-cage support;

a waist belt arranged for fastening said pack frame about the waist of a user and defining a position of attachment of said waist belt; and an adjustment mechanism supported to said lower frame module of said pack frame for adjusting the position of attachment of said shoulder supports, rib-cage support and waist belt so as to simultaneously increase and decrease the length of said shoulder supports, the length of said rib-cage support and the distance between said waist belt and said lower frame module while said pack frame is being worn by the user.

11. A load carrying equipment according to claim 10, wherein said upper frame module comprises two substantially parallel upper vertical support members connected at one end by an upper horizontal member, wherein said upper horizontal member provides an upper quick release mechanism for mounting the upper portion of said pack load module; and wherein said lower frame module comprises two substantially parallel lower vertical support members connected at one end by a lower horizontal member, wherein said lower horizontal member provides a lower quick release mechanism for mounting the lower portion of said pack load module.

12. A load carrying equipment according to claim 10, further comprising a rotatable gear secured to said upper frame module between said shoulder supports adapted to simultaneously adjust the position of each of said shoulder supports to a predetermined spaced apart distance.

13. A load carrying equipment, comprising:

a pack frame including a lower frame module and an upper frame module wherein said modules are flexibly attached;

a pack load module including a front plane and back plane; and a quick release retention mechanism attached to said upper frame module and lower frame module for connecting said pack load module to said pack frame;

said back plane having a plurality of studs protruding therefrom which are slidably positioned within said quick release retention mechanisms;

said quick release mechanism including a coupling member suitable for retaining one of said studs on said back plane, said coupling member comprising a first annular member having a first end, a second end, a diameter portion which is adapted for receiving one of said studs and a restricted opening portion, and a plunger member having a large diameter portion which is slidably positioned within said first annular member, a reduced diameter portion which extends from said larger diameter portion toward said first end, and a transversely extending shoulder portion at a juncture between said larger diameter and said reduced diameter of said plunger.

14. A load carrying equipment according to claim 13, further comprising:

a spring member resiliently trapped between said restricted portion and said shoulder portion for resiliently urging said plunger toward said second end of said annular member, a retaining member circumscribing and axially displaceable with respect to said annular member;

said retaining member engaging a free end of said one of said studs providing an axial restraint on said one of said studs greater than the axial biasing force of said spring against said one of said studs, said axial restraint being overcome upon said retaining member being displaced toward said second end of said annular member; and a displacement mechanism disposed within said annular member for simultaneously displacing said retaining member of said quick release retention mechanism thereby detaching said pack module from said pack frame.

15. A load carrying equipment according to claim 13, further comprising:

a spring member resiliently trapped between said restricted portion and said shoulder portion for resiliently urging said plunger toward said second end of said annular member; and a retaining member circumscribing and axially displaceable with respect to said annular member;

said plunger comprising an O-ring sealing member between the outside of said larger diameter portion of said plunger and the inside of said annular member to permit limited axial misalignment between said annular member and said plunger without permitting debris and/or fluid passage therebetween;

said retaining member engaging a free end of said one of said studs providing an axial restraint on said one of said studs greater than the axial biasing force of said spring against said one of said studs, said axial restraint being overcome upon said retaining member being displaced toward said second end of said annular member.

16. In a fully integrated, multi functional, soldier-centered, computer enhanced warfare system, a load carrying equipment, comprising:

multiple pack load modules;

a pack frame including a lower frame module and an upper frame module wherein said modules are flexibly attached;

a quick release retention mechanism attached to said upper frame module and lower frame module for engaging and disengaging said pack load module to said pack frame;

shoulder support members arranged for fastening said pack frame about the upper body portion of a user and defining a position of attachment of said shoulder support;

rib-cage support member arranged for fastening said pack frame about the torso portion of the user and defining a position of attachment of said rib-cage support;

a waist belt arranged for fastening said pack frame about the waist of a user and defining a position of attachment of said waist belt; and an adjustment mechanism supported to said lower frame module of said pack frame for adjusting the position of attachment of said shoulder support, rib-cage support and waist belt so as to simultaneously increase and decrease the length of said shoulder support, the length of said rib-cage support and the distance between said waist belt and said lower frame module while said pack frame is being worn by the user.

17. A load carrying equipment according to claim 16, wherein said multiple load packs include: a central approach pack module having a back plane for attaching said approach pack to said quick release retention mechanism; a first side pack module and a second side pack module attached to the sides of said approach pack module; and a sustainment pack module attachable to said approach pack or to said lower frame module.

18. A load carrying equipment according to claim 17, further comprising a seal joint for securing said pack modules to said approach pack, said seal joint including a generally C-shaped elongated rail member molded along the periphery of said back plane of said approach pack and further including a support element extending from said side pack modules and said sustainment pack module cooperating with said rail members whereby said support elements are positioned to be grasped within said rail member.

19. A load carrying equipment according to claim 16, wherein said warfare system further comprises electrical components integrated within said frame pack.

20. A load carrying equipment according to claim 16, further comprising a housing supported to said lower frame module for containing said quick release retention mechanism.

21. A human portable carrier comprising:

a frame formed of frame members;

a pair of shoulder straps for mounting said frame to the shoulders of a human carrier bearer;

a device for positioning said frame at a lower point of the torso of the bearer, said device being movably attached to said frame for movement relative to said frame; and an adjustment mechanism for moving said device relative to said frame to alter a length of the carrier, the adjustment mechanism comprising a screw, a mount for said screw, said mount being carried by one of said frame and device for positioning, said screw being rotatably mounted in said mount, and a member connected to said screw for rotating said screw.

22. A human portable carrier according to claim 22, wherein said adjustment mechanism comprises a driver mounted for movement along said screw and driven by rotation of said screw, a link connected to said driver at one end of said link, said link being pivotally attached at another end to an anchoring portion on the other of said frame and device for positioning, said screw when rotated by said member causing said driver to move along said screw and moving said frame and said device for positioning relative to one another via said link.

23. A human portable carrier comprising:

a frame formed of frame members;

a pair of shoulder straps for mounting said frame to the shoulders of a human carrier bearer;

a belt for mounting said frame about a lower point of the torso of the bearer;

a belt attachment mechanism for movably attaching said belt to said frame for movement relative to said frame, said attachment mechanism including a yoke having two links, each of said links having a first end pivotally attached to an anchor carried on one of said belt and said frame, a second end of each of said links being attached to one of two respective drivers, and a drive engaging said drivers for moving said drivers relative to one another to cause said second ends of said links to move relative to one another and thereby move said belt and frame relative to one another.

24. A human portable carrier comprising:

a frame formed of frame members;

a pair of shoulder straps for mounting said frame to the shoulders of a human carrier bearer;

a belt for mounting said frame about a lower point of the torso of the bearer;

a belt attachment mechanism for movably attaching said belt to said frame for movement relative to said frame, said attachment mechanism including a link, said link having a first end pivotally attached to an anchor carried on one of said belt and said frame, a second end of said link being attached to a driver, and a drive engaging said driver for moving said driver to cause said first end of said link to move and thereby move said belt and frame relative to one another.

25. A human portable carrier comprising:

a frame formed of frame members;

a pair of shoulder straps for mounting said frame to the shoulders of a human carrier bearer, each said straps being mounted to said frame at one end by a strap mount which is movably mounted to said frame for relative movement to said frame;

a belt for mounting said frame about a lower point to the torso of the bearer;

a belt attachment mechanism for movably attaching said belt to said frame for movement relative to said frame, said attachment mechanism including a rigid member extending between said frame and said belt, said rigid member being movably mounted at one end thereof to one of said frame and belt, said rigid member being mounted at another end to the other of said frame and belt, a driver engaging said rigid member for moving said rigid member, movement of said rigid member causing said belt and frame to move relative to one another to change a length of the carrier;

a cable connecting said driver and said movable mount of said straps, said driver engaging said cable and causing said cable to move said movable mount of said straps simultaneously with movement of said rigid member for moving said straps relative to said frame.

26. A human portable carrier comprising:

a frame;

a plurality of items each adapted to be carried by said frame;

a plurality of attachment devices for attaching each item to said frame, each said attachment device having one part carried on an item and a mating part carried on said frame, said parts releasably engaging with each other, said mating part on said frame comprising a first annular member having a first end, a second end; a diameter portion which is adapted for receiving one of said parts, a restricted opening portion, and a plunger member having a large diameter portion which is slidably positioned within said first annular member, a reduced diameter portion which extends from said larger diameter portion toward said first end, and a transversely extending shoulder portion at a juncture between said larger diameter and said reduced diameter of said plunger; and a mechanism remote from said attachment devices which effects disengagement of said parts of each said attachment device of items carried on said frame substantially simultaneously.

* * * * *